US007723001B2

(12) United States Patent
Kim

(10) Patent No.: US 7,723,001 B2
(45) Date of Patent: May 25, 2010

(54) ELECTROPHOTOGRAPHIC TONER

(75) Inventor: Sang-woo Kim, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 316 days.

(21) Appl. No.: 11/878,214

(22) Filed: Jul. 23, 2007

(65) Prior Publication Data

US 2008/0153024 A1 Jun. 26, 2008

(30) Foreign Application Priority Data

Dec. 20, 2006 (KR) ..... 10-2006-0130835

(51) Int. Cl.
*G03G 9/00* (2006.01)

(52) U.S. Cl. ..... 430/108.6; 430/108.7

(58) Field of Classification Search ..... 430/109.1, 430/108.6, 108.7
See application file for complete search history.

(56) References Cited

U.S. PATENT DOCUMENTS 7,309,556 B2 * 12/2007 Mc Dougall et al. ..... 430/108.6
2004/0229145 A1 * 11/2004 Lee et al. ..... 430/108.6
2006/0251977 A1 * 11/2006 Kim ..... 430/108.3

FOREIGN PATENT DOCUMENTS

JP 2005-37469 2/2005
KR 10-2006-0062631 6/2006

* cited by examiner

*Primary Examiner*—John L Goodrow
(74) *Attorney, Agent, or Firm*—Roylance, Abrams, Berdo & Goodman, L.L.P.

(57) ABSTRACT

An electrophotographic toner includes toner parent particles containing a binder resin, a colorant and a charge control agent; and an external additive added to the surface of the toner parent particles. The toner further includes positively chargeable silica and polymer beads in addition to large particle diameter silica, small particle diameter silica and titanium oxides. Thus, the toner can maintain its charge quantity and distribution stably even during environmental changes and after long image printing times, thereby preventing the contamination of the non-image part and the filming.

10 Claims, 1 Drawing Sheet

ELECTROPHOTOGRAPHIC TONER

CROSS-REFERENCE TO RELATED PATENT APPLICATION

This application claims the benefit of Korean Patent Application No. 10-2006-0130835, filed on Dec. 20, 2006, in the Korean Intellectual Property Office, the disclosure of which is herein incorporated by reference in its entirety.

BACKGROUND OF THE INVENTION

1. Field of the Invention

The present invention relates to an electrophotographic toner. More particularly, the invention relates to an electrophotographic toner that is able to produce a high quality image with uniform density without the contamination of image due to a non-control toner. The electrophotographic toner of the invention does not generate filming action on a photoconductor that is normally due to contamination by an external additive. The toner also maintains charge quantity and charge distribution stably over a long period of time in an electrophotographic image forming apparatus.

2. Description of the Related Art

Currently, electrophotographic image processing machines such as a laser printer, a facsimile and a copying machine, etc. are widely used. The image forming apparatus forms a latent image on a photoconductor by using a laser, migrate a toner onto the latent image formed on the photoconductor by employing electric potential difference, and transfer the latent image to a printing medium such as a paper to give a desired image.

FIG. 1 illustrates an example of a non-contact developing type electrophotographic image forming apparatus, of which operating mechanism is described below.

A non-magnetic one-component toner 8 is fed on a developing roller 5 by a feeding roller 6 made of an elastic member such as polyurethane foam or a sponge, and the like. The toner 8 supplied to the developing roller 5 arrives at the contacting part between a toner control blade 7 and the developing roller 5 through the rotation of the developing roller 5. The toner control blade 7 is made of an elastic member such as metal or a rubber, and the like. When the toner 8 is passed through the contacting area of the toner control blade 7 and the developing roller 5, the toner 8 is controlled and formed in a uniform layer to form a thin layer and to charge the toner sufficiently. Thin layered toner 8 migrates from the developing roller 5 to a developing area on the photoconductor 1 where the toner 8 is developed on an electrostatic latent image on the photoconductor 1.

The developing roller 5 is spaced from the photoconductor 1, without contacting each other in some intervals. The developing roller 5 rotates in a counterclockwise direction, and the photoconductor 1 rotates in a clockwise direction. The toner 8 that migrates to the developing area is developed on the electrostatic latent image of the photoconductor 1 by electric power generated by electric potential difference between the DC-offset AC voltage applied to the developing roller 5 and the electric potential of the latent image on the photoconductor 1.

The toner 8 developed on the photoconductor 1 arrives at a position of a transferring means 9 by the rotating direction of the photoconductor 1. The toner developed on the photoconductor 1 is transferred on a printing paper 13, which is passed between the photoconductor 1 and the transfer means by the transferring means 9 on which high voltage having counter polarity to the toner 8 is applied through corona discharge or in roller form, to form an image.

While the image transferred to the printing paper is passed through a fusing apparatus (not shown) at high temperature and high pressure, the toner is melted on the printing paper and thus the image is fused thereon. Meanwhile, the undeveloped toner remaining on the developing roller 5 is recovered by the feeding roller 6 in contact with the developing roller 5.

Such procedures are repeated to form a desired image.

Recently, high quality of images are required as electrophotographic image forming apparatuses such as an electrophotographic LBP, a multifunction machine and a color-copying machine are widely distributed. A toner used in a developing apparatus for this purpose is intended to possess the properties such as stable charge quantity and developing efficiency, and provide anti-fogging even during environmental changes and extended image printing times.

As an approach to control the stabilization of charge quantity in a toner, anti-fogging, and enhancing developing efficiency, and the like, various external additives such as silica, titanium oxide or titanium dioxide ($TiO_2$), aluminum oxide ($A_2O_3$), strontium titanate ($SrTiO_3$), barium titanate ($BaTiO_3$) and calcium titanate ($CaTiO_3$) are added to a toner, but there is a limitation in improving the image quality. That is, variation in charging property of a toner to environmental changes such as low temperature-low humidity and high temperature-high humidity occurs frequently, and uniform charge quantity and distribution is maintained in initial printing, but the drop of charge quantity occurs greatly during standing. Further, the drop of image density, fogging and toner scattering occur due to the drop of charge quantity and non-uniform charge distribution in image printing over long periods.

Accordingly, the types of various external additives to be added for improving image quality are increasing, and the amount of external additives added is progressively increasing. These external additives should maintain continuously stable adhesion state on a toner surface during long term printing, however, they are, in fact, impregnated into toner particles or some of them cause the contamination of a developing member due to their separation or departing, or the contamination of images therefrom. It has been found that such separation or departing of the external additives increases as the particle size of these external additives increases and the cohesive force between external additives increases. The separation becomes more severe due to the increase in the types and amounts of the external additives.

Particularly, a long lifetime of more than 10,000 copies is required for the recent color image forming apparatus. In these apparatus, the internal contamination in the image forming apparatus due to the external additives becomes more severe, thereby limiting the lifetime of the apparatus. Further, an image forming apparatus, in particular, the compaction in the inside member of a developing device and the roller type is promoted due to the need of compaction to set size, and in this case, the drop of image density and uniformity, and the contamination of a non-image part tends to occur easily due to the lack of absolute charge quantity and charging speed.

SUMMARY OF THE INVENTION

The present invention provides an electrophotographic toner that is able to maintain its charge quantity and charge distribution stably even during environmental changes and long image printing times. The toner maintains the charge quantity and charge distribution, thereby ensuring a uniform image density, preventing the contamination of a non-image part (background) due to a non-control toner, and preventing the image contamination due to the contamination of a developing member by the separation or departing of external additives from the toner particles.

According to an aspect of the present invention, an electrophotographic toner comprising toner parent particles is provided containing a binder resin, a colorant and a charge control agent; and an external additive added to the surface of the toner parent particles, wherein the external additive includes large particle diameter silica having a primary average particle diameter of about 30 to 100 nm; a small particle diameter silica having a primary average particle diameter of about 5 to 20 nm; titanium oxides; polymer beads having a primary average particle diameter of about 100 to 500 nm; and positively chargeable silica having a primary average particle diameter of about 20 to 100 nm.

In accordance with an exemplary embodiment of the present invention, the polymer beads may be included in an amount of about 0.1 to 1.0 parts by weight based on 100 parts by weight of the toner parent particles.

In accordance with another exemplary embodiment of the present invention, the positively chargeable silica may be included in an amount of about 0.1 to 1.0 parts by weight based on 100 parts by weight of the toner parent particles.

In accordance with still another exemplary embodiment of the present invention, the large particle diameter silica may be included in and amount of about 0.1 to 2.0 parts by weight based on 100 parts by weight of the toner parent particles.

In accordance with still yet another exemplary embodiment of the present invention, the small particle diameter silica may be included in an amount of about 0.1 to 2.0 parts by weight based on 100 parts by weight of the toner parent particles.

In accordance with another exemplary embodiment of the present invention, the titanium oxide may be included in an amount of about 0.1 to 2.0 parts by weight based on 100 parts by weight of the toner parent particles.

In accordance with another exemplary embodiment of the present invention, the positively chargeable silica may have an amino group or an amide group on its surface.

In accordance with another exemplary embodiment of the present invention, the polymer beads may be melamine-based beads or polymethylmethacrylate beads.

An electrophotographic toner according to the present invention can maintain the charge quantity and the charging speed stably over a long period of time by including a positively chargeable silica and polymer beads in addition to two types of the negatively chargeable silica having different sizes and titanium oxides on the surface of the toner particles.

These and other aspects of the invention will become apparent from the following detailed description of the invention which disclose various embodiments of the invention.

BRIEF DESCRIPTION OF THE DRAWINGS

The above and other features and advantages of the present invention will become more apparent by describing in detail exemplary embodiments thereof with reference to the attached drawing in which.

DETAILED DESCRIPTION OF THE INVENTION

Figure 1:
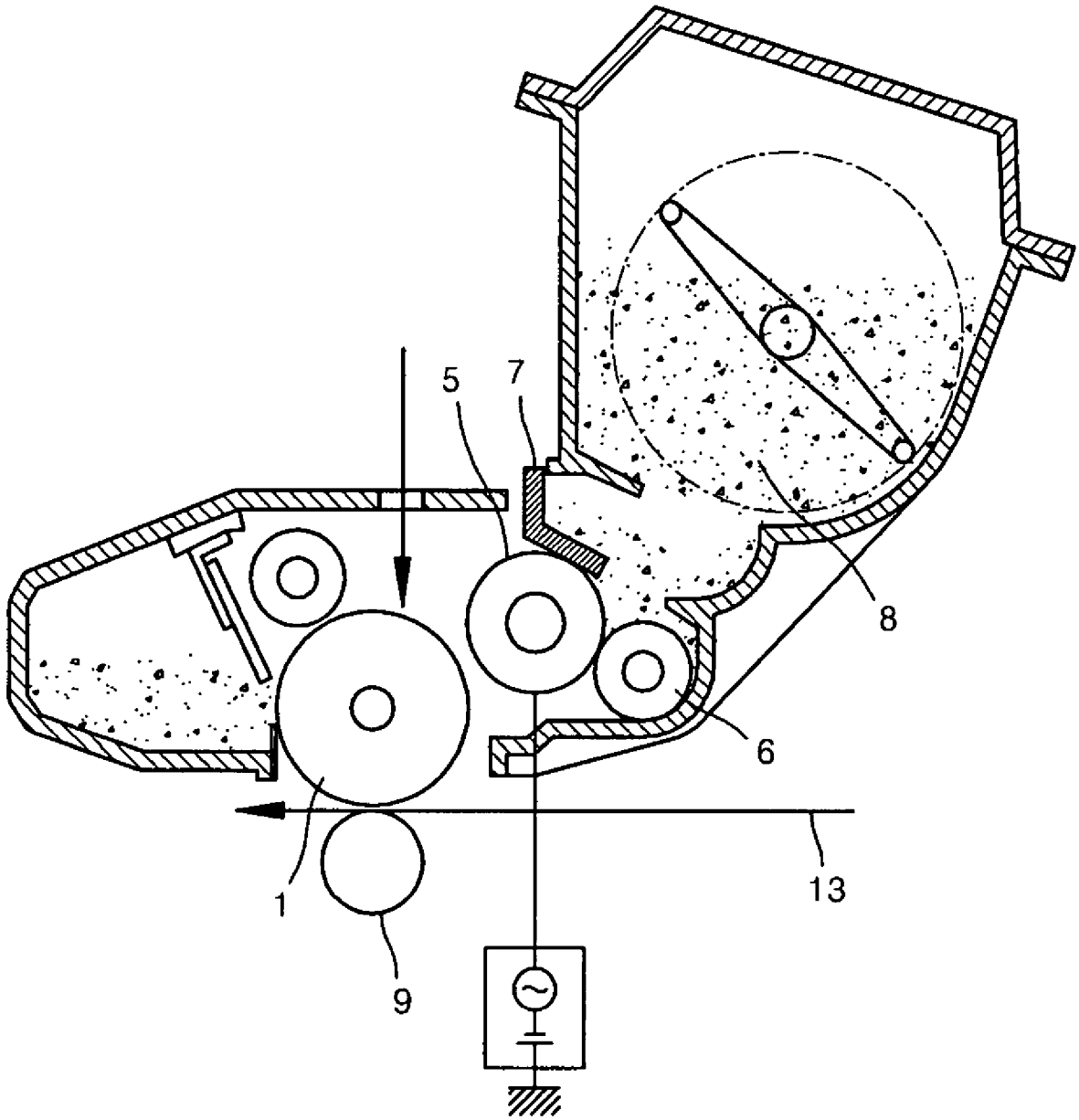
FIG. 1 is a schematic diagram showing an exemplary embodiment of a non-contact developing type electrophotographic image forming apparatus.

The present invention will now be described more fully hereinafter.

The present invention provides an electrophotographic toner comprising toner parent particles containing a binder resin, a colorant and a charge control agent; and an external additive added to the surface of the toner parent particles, wherein the external additive includes large particle diameter silica having a primary average particle diameter of about 30 to 100 nm; small particle diameter silica having a primary average particle diameter of about 5 to 20 nm; titanium oxides; polymer beads having a primary average particle diameter of about 100 to 500 nm; and positively chargeable silica having a primary average particle diameter of about 20 to 100 nm.

In accordance with an exemplary embodiment of the present invention, the positively chargeable silica has an amino group or an amide group on its surface, thereby generating positive charging by the frictional contact with the binder resin. Thus, the positively chargeable silica plays a similar role as a carrier of a two component-based developing agent due to such positive charging, and accordingly maintains the charge quantity and the charging speed stably over a long lifetime.

The positively chargeable silica having an amino group or an amide group on its surface is commercially available, or may be prepared by treating the surface of silica with a silane-coupling agent having an amino group or an amide group. The method of treating the surface includes dry type or wet type methods. Examples of such methods include a method of introducing silica and a desired amount of a surface-treating agent into a mixer such as Henschel mixer or ball mill to mix in a dry manner, or a method of dissolving a surface-treating agent in a suitable solvent, then introducing silica thereto, mixing, and removing the solvent.

The small particle diameter silica and the large particle diameter silica used in an electrophotographic toner according to the present invention are added to the toner parent particles to impart a negatively charging property and fluidity. Particles manufactured by a dry type method from silicon halides, and particles manufactured by a wet type method, e.g., deposited from silicon compounds in a solution, can be both used.

Large particle diameter silica has the primary average particle diameter of about 30 to 100 nm, and enhances separating property between toner parent particles or between toner parent particles and the surface thereof. In one embodiment of this invention, the large and small particle diameter silica particles do not have a surface treatment. In another embodiment, the large and small particle diameter silica particles can be surface treated with one or more surface treatment agents. Small particle diameter silica has the primary average particle diameter of about 5 to 20 nm, and impart fluidity to the toner.

The content of the large particle diameter silica and the small particle diameter silica is each independently about 0.1 to 2.0 parts by weight based on 100 parts by weight of the toner parent particles. If the content is less than 0.1 parts by weight, it is not preferable since it is difficult to obtain effects from the addition of the silica. If the content exceeds 2.0 parts by weight, it is not preferable since the fusing property is dropped, and hyper-charging and cleaning failure occur.

If only the silica having a relatively large specific surface area is used, it produces significantly good results. However, in the case of large amounts of printing for long periods of time, the drum can be contaminated, and thus an inorganic particulate other than silica can be used in order to prevent such contamination. Material that can be used as the inorganic particulate includes titanium oxides such as titanium oxide and strontium titanate. Preferably, titanium oxide may be used.

Titanium oxides used in the present invention can enhance the fluidity of a toner, and maintain high transferring efficiency even in the case of extensive printing for long periods of time. Further, it can prevent the contamination of the drum, thereby improving environmental stability. Particularly, it can prevent the problems of the charge-up of a toner at low temperature-low humidity, and the charge-down of a toner at high temperature-high humidity. The primary average particle diameter of titanium oxide is usually a few to several nm. The content of the titanium oxides may be about 0.1 to 2.0 parts by weight based on 100 parts by weight of the toner parent particles. If the content of the titanium oxide is less than 0.1 parts by weight, there is no effect of maintaining the chargeability according to an environment. If the content of the titanium oxide exceeds 2.0 parts by weight, there is an unfavorable problem of the image contamination and the drop of charge quantity. The term titanium oxide as used herein refers to titanium dioxide and metal titanates. Suitable metal titanates include strontium titanate, barium titanate and calcium titanate.

For preparing a toner according to the present invention, polymer beads are used in addition to the additive. Polymer beads are used in order to prevent the contamination of the non-image part due to drop of charge quantity. The suitable type of the polymer beads includes melamine-based beads or polymethylmethacrylate (PMMA). The first average particle diameter of the polymer beads may be in a range of about 0.1 to 1 μm, and may be in a range of about 0.1 to 0.5 μm. If the first average particle diameter of the polymer beads is smaller than 0.1 μm, its effect cannot be expected. If the first average particle diameter of the polymer beads exceeds 0.5 μm, they may be unfavorably separated or departed easily from the toner parent particles. The melamine-based beads or polymethylmethacrylate can be used alone or in combination. The total content of the polymer beads used may be about 0.1 to 1.0 parts by weight based on 100 parts by weight of the toner parent particles. If the total content is less than 0.1 parts by weight, its effect cannot be expected. If the total content exceeds 1.0 part by weight, they may be unfavorably separated or departed easily from the toner, and be aggregated by themselves.

The toner parent particles according to the present invention comprise a binder resin, a colorant and a charge control agent.

Various known resins can be used as binder resins used in the toner according to the present invention. For example, styrene copolymers such as polystyrene, poly-p-chlorostyrene, poly-α-methylstyrene, styrene-chlorostyrene copolymer, styrene-propylene copolymer, styrene-vinyltoluene copolymer, styrene-vinylnaphthalene copolymer, styrene-acrylic acid methyl copolymer, styrene-acrylic acid ethyl copolymer, styrene-acrylic acid propyl copolymer, styrene-acrylic acid butyl copolymer, styrene-acrylic acid octyl copolymer, styrene-methacrylic acid methyl copolymer, styrene-methacrylic acid ethyl copolymer, styrene-methacrylic acid propyl copolymer, styrene-methacrylic acid butyl copolymer, styrene-α-chloromethacrylic acid methyl copolymer, styrene-acrylonitrile copolymer, stryrene-vinylmethylether copolymer, stryrene-vinylethylether copolymer, stryrene-vinylethylketone copolymer, styrene-butadiene copolymer, styrene-acrylonitrile-indene copolymer, styrene-maleic acid copolymer, and styrene-maleic acid ester; polymethylmethacrylate, polyethylmethacrylate, polybutylmethacrylate and copolymers thereof; polyvinyl chloride, polyvinyl acetate acid, polyethylene, polypropylene, polyester, polyurethane, polyamide, epoxy resin, polyvinylbutyral resin, rosin, denatured rosin, terpene resin, phenol resin, aliphatic or alicyclic hydrocarbon resin, aromatic petroleum resin, chlorinated paraffin chloride, paraffin wax, and the like, can be used alone or in combination. Of these, polyester-based resins are suitable for a color-developing agent due to excellent fusing property and transparency. In one embodiment, the binder resin is a polyester resin having a weight average molecular weight of about 100,000. The binder resin has a weight average molecular weight as commonly used in the art, for example, from about 60,000 to about 100,000.

A toner according to the present invention can comprise a colorant. For a black and white toner, carbon black or aniline black can be used as such a colorant. With a non-magnetic toner according to the present invention, it is easy to prepare a color toner. Further, a color toner comprises carbon black for black color, and comprises yellow, magenta and cyan colorant for various colors.

The yellow colorant can be a condensed nitrogen compound, an isoindolinone compound, an anthraquinone compound, an azo metal complex or an allyl imide compound. Specific examples include C.I. pigment yellow 12, 13, 14, 17, 62, 74, 83, 93, 94, 95, 109, 110, 111, 128, 129, 147 or 168, and the like, can be used.

The magenta colorant can be a condensed nitrogen compound, an anthraquinone compound, a quinacridone compound, a basic dye lake compound, a naphthol compound, a benzoimidazole compound, a thioindigo compound or a perylene compound. Specific examples include C.I. pigment red 2, 3, 5, 6, 7, 23, 48:2, 48:3, 48:4, 57:1, 81:1, 144, 146, 166, 169, 177, 184, 185, 202, 206, 220, 221 or 254, and the like, which can be used.

The cyan colorant can be a copper phthalocyanine compound and its derivative, an anthraquinone compound or a basic dye lake compound. Specific examples include C.I. pigment blue 1, 7, 15, 15:1, 15:2, 15:3, 15:4, 60, 62 or 66, and the like, which can be used.

These colorants can be used alone or in a mixture of at least two types of colorants, and can be selected in consideration of color, saturation, brightness, weather proofness, dispersibility in toners, and the like.

A charge control agent used in the present invention can be a negative charge control agent or a positive charge control agent. The negative charge control agent can be an organic metal complex such as a chromium-containing azo dye or a monoazo metal complex, or a chelate compound; a salicylic acid compound containing metals such as chromium, iron and zinc; and an organic metal complex of aromatic hydroxycarboxylic acid and aromatic dicarboxylic acid can be used, and is not particularly limited to these. Further, nigrosine and a product modified with fatty acid metal salt thereof, etc., and onium salt containing quaternary ammonium salt such as tributylbenzylammonium 1-hydroxy-4-naphthosulfonate and tetrabutylammonium tetrafluoroborate, and the like, can be used alone or in a mixture of two kinds of the compounds as the positive charge control agent. These charge control agents support the toner to be stable on a developing roller by electrostatic force. Thus, the use of these charge control agents enables the charging speed to be stable and fast.

Meanwhile, the toner particles according to an embodiment of the present invention may further comprise a release agent, a higher fatty acid or a metal salt thereof. The release agent includes a polyalkylene wax such as low molecular weight polypropylene and low molecular weight polyethylene, ester wax, carnauba wax, paraffin wax, higher fatty acid and fatty acid amide. The higher fatty acid and salts thereof can be used properly in order to obtain high image qualities by protecting a photoconductor and preventing the deterioration of developing properties.

Flushing may be performed or a master batch melted and kneaded with a resin in high concentration may be employed in advance so that a colorant may be dispersed uniformly in a resin. For example, a binder resin and a colorant may be mixed as essential components of the toner particles by a kneading means such as a 2-roll, a 3-roll, a pressurized type kneader or twin-screw extruder. Herein, the colorant is dispersed uniformly and the mixture is melted and kneaded at a temperature of about 80 to 180° C. for 10 minutes to 2 hours. Then, the resulting product is pulverized using a milling machine such as a jet mill, an attritor mill or a rotary mill, to produce toner particles having an average particle size of about 3 to 15 μm. The powder rheology or charge stability, and the like, are enhanced by attaching an external additive to the surface of the toner particles.

The toner according to an embodiment of the present invention can also be prepared by a polymerization method as an alternative to a melt-kneading pulverizing method. To attach the external additives to toner particles, the toner particles and the external additives were combined in a desired ratio, and the mixture was placed in an agitator and stirred such that the external additives could attach to the surface of the toner particles by mixing, or both particles were placed in a surface modifier such as 'Nara hybridizer' and stirred such that the external additives could attach to the toner particles by embedding at least part of the external additive particles on the surface of the toner particles.

The toner according to the present invention can be also applied to a contact non-magnetic one component developing type toner in addition to an electrophotographic apparatus using the non-contact non-magnetic one component toner.

The present invention will be described in greater detail with reference to the following examples. The following examples are for illustrative purposes only and are not intended to limit the scope of the invention.

EXAMPLES

Preparation of Toner Parent Particles (the Grinding Type of a Negatively Chargeable Toner)

The constitution of the toner parent particles in non-magnetic one component developing type is as follows:

| | |
|---|---|
| Polyester resin as the binder resin having a weight-average molecular weight of 100,000 | 93.0% by weight |
| Colorant (Carbon black, manufactured by Mitsubishi Chemical Co.) | 3.0% by weight |
| Negatively chargeable charge control agent (Hodogaya, n complex) | 1.0% by weight |
| Carnauba wax | 3.0% by weight |

The components above were premixed uniformly using a Henschel-type mixer. Then, the premixture was infused to a biaxial extruder and a melted mixture was extruded at 130° C. The extrudate was coagulated while cooled. Then, toner parent particles were obtained from the extrudate using a grinding classifier prior to external addition step having an average particle diameter of about 8 μm.

Example 1

A toner was prepared by adding the following external additives to the toner parent particles prepared by the grinding type method. The content of the external additives is based on 100 parts by weight of the toner parent particles.

| | |
|---|---|
| Positively chargeable silica (primary particle diameter: 30~50 nm) | 0.5 parts by weight |
| Large particle diameter silica (primary particle diameter: 30~50 nm) | 1.5 parts by weight |
| Small particle diameter silica (primary particle diameter: 7~16 nm) | 1.0 parts by weight |
| Titanium dioxide (primary particle diameter: 40~70 nm) | 0.2 parts by weight |
| Melamine beads (primary particle diameter: 150~250 nm) | 0.2 parts by weight |

Example 2

A toner was prepared by adding the following external additives to the toner parent particles prepared by the grinding type method. The content of the external additives is based on 100 parts by weight of the toner parent particles.

| | |
|---|---|
| Positively chargeable silica (primary particle diameter: 30~50 nm) | 0.5 parts by weight |
| Large particle diameter silica (primary particle diameter: 30~50 nm) | 1.5 parts by weight |
| Small particle diameter silica (primary particle diameter: 7~16 nm) | 0.8 parts by weight |
| Strontium titanate (primary particle diameter: 10~20 nm) | 0.6 parts by weight |
| Polymethylmethacrylate beads (primary particle diameter: 200~300 nm) | 0.1 parts by weight |

Comparative Example 1

A toner was prepared by adding the following external additives to the toner parent particles prepared by the grinding type method. The content of the external additives is based on 100 parts by weight of the toner parent particles.

| | |
|---|---|
| Large particle diameter silica (primary particle diameter: 30~50 nm) | 2.0 parts by weight |
| Small particle diameter silica (primary particle diameter: 7~16 nm) | 1.0 parts by weight |
| Titanium oxide (primary particle diameter: 40~70 nm) | 0.2 parts by weight |
| Melamine beads (primary particle diameter: 50~100 nm) | 1.5 parts by weight |

Comparative Example 2

A toner was prepared by adding the following external additives to the toner parent particles prepared by the grinding type method. The content of the external additives is based on 100 parts by weight of the toner parent particles.

| | |
|---|---|
| Positively chargeable silica (primary particle diameter: 30~50 nn) | 0.5 parts by weight |
| Large particle diameter silica (primary particle diameter: 30~50 nm) | 2.0 parts by weight |
| Small particle diameter silica (primary particle diameter: 7~16 nm) | 0.8 parts by weight |
| Strontium titanate (primary particle diameter: 10~20 nm) | 0.6 parts by weight |

Image Evaluation Test (Based on a Negatively Chargeable Toner)

Surface electric potential ($V_0$): −700V

Latent image electric potential ($V_L$): −100V

Voltage applied to the developing roller: $V_{P-P}$=1.8 KV, frequency=2.0 kHz, $V_{dc}$=−500V, cycle ratio=35% (spherical wave)

Developing gap: 150~400 μm

Developing roller:

(1) For aluminum

Roughness: Rz=1~2.5 (after doping with)

(2) Rubber roller (NBR-based elastic rubber roller)

resistance: $1\times10^5\Omega$ to $5\times10^6\Omega$

Hardness: 50

Toner: Charge quantity (q/m)=−5 to −30 μC/g (on a developing roller after passing through a toner layer control apparatus)

Toner weight per area (m/a)=0.3 mg/cm$^2$ to 1.0 mg/cm$^2$

Evaluation of Images (Based on a Negatively Chargeable Toner)

Images were evaluated for the toners of Examples 1 and 2, and Comparative Examples 1 and 2 by employing 16 pm grade LBP. The performance of each toner was evaluated with the naked eye by determining the filming on the photoconductor surface, the contamination of a non-image part (background on yellow) and the periodic contamination of image in the charging roller (CR).

TABLE 1

Filming on the photoconductor surface

| | Print numbers | | | | | |
|---|---|---|---|---|---|---|
| | Initial | 2,000 | 4,000 | 6,000 | 8,000 | 10,000 |
| Example 1 | ○ | ○ | ○ | ○ | ○ | Δ |
| Example 2 | ○ | ○ | ○ | ○ | ○ | ○ |
| Comp. Example 1 | ○ | ○ | Δ | X | — | — |
| Comp. Example 2 | ○ | ○ | Δ | X | — | — |

TABLE 2

Contamination of the non-image part (background on yellow)

| | Print numbers | | | | | |
|---|---|---|---|---|---|---|
| | Initial | 2,000 | 4,000 | 6,000 | 8,000 | 10,000 |
| Example 1 | ○ | ○ | ○ | ○ | ○ | Δ |
| Example 2 | ○ | ○ | ○ | ○ | ○ | ○ |
| Comp. Example 1 | ○ | ○ | Δ | X | — | — |
| Comp. Example 2 | ○ | ○ | ○ | ○ | Δ | Δ |

TABLE 3

CR periodic contamination of image

| | Print numbers | | | | | |
|---|---|---|---|---|---|---|
| | Initial | 2,000 | 4,000 | 6,000 | 8,000 | 10,000 |
| Example 1 | ○ | ○ | ○ | ○ | ○ | ○ |
| Example 2 | ○ | ○ | ○ | ○ | ○ | Δ |
| Comp. Example 1 | ○ | ○ | Δ | X | — | — |
| Comp. Example 2 | ○ | ○ | ○ | ○ | ○ | ○ |

From Tables 1 to 3 above, the filming on the photoconductor surface, the contamination of the non-image part (background on yellow) and the periodic contamination of image in the charging roller (CR) were evaluated with the naked eye as follows: In cases where the above troubles did not occur, the result is expressed as "○", and in cases where the above troubles occurred slightly, the result is expressed as "Δ", and in cases where the above troubles occurred seriously, the result is expressed as "X". Lifetime test was stopped after the result is determined as X in all tests.

As can be seen from the above results, when the toner of Examples 1 and 2 comprises positively chargeable silica and polymer beads as external additives, the filming of the photoconductor surface, the contamination of the non-image part and the periodic contamination of image in the charging roller did not occur or occurred far less than Comparative Examples 1 and 2.

The toner according to the present invention further comprises positively chargeable silica and polymer beads as external additives. Thus, the toner can be used in various electrophotographic image-forming apparatuses since it prevents the contamination of a non-image part at initial time and over long period, and prevents the filming, thereby maintaining charge quantity.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electrophotographic toner comprising toner parent particles containing a binder resin, a colorant and a charge control agent; and an external additive added to the surface of the toner parent particles, wherein the external additive includes large particle diameter silica having a primary average particle diameter of about 30 to 100 nm; small particle diameter silica having a primary average particle diameter of about 5 to 20 nm; titanium dioxide or metal titanate; polymer beads having a primary average particle diameter of about 100 to 500 nm; and a positively chargeable silica having a primary average particle diameter of about 20 to 100 nm.

2. The electrophotographic toner of claim 1, wherein the positively chargeable silica is present in an amount of about 0.1 to 1.0 parts by weight based on 100 parts by weight of the toner parent particles.

3. The electrophotographic toner of claim 1, wherein the polymer beads are present in an amount of about 0.1 to 1.0 parts by weight based on 100 parts by weight of the toner parent particles.

4. The electrophotographic toner of claim 1, wherein the large particle diameter silica is present in an amount of about 0.1 to 2.0 parts by weight based on 100 parts by weight of the toner parent particles.

5. The electrophotographic toner of claim 1, wherein the small particle diameter silica is present in an amount of about 0.1 to 2.0 parts by weight based on 100 parts by weight of the toner parent particles.

6. The electrophotographic toner of claim 1, wherein the titanium dioxide is present in an amount of about 0.1 to 2.0 parts by weight based on 100 parts by weight of the toner parent particles.

7. The electrophotographic toner of claim 1, wherein the positively chargeable silica includes an amino group or an amide group on a surface thereof.

8. The electrophotographic toner of claim 1, wherein the polymer beads are melamine-based beads or polymethymethacrylate beads.

9. The electrophotographic toner of claim 1, wherein the metal titanate is strontium titanate.

10. An electrophotographic toner comprising toner parent particles containing a binder resin, a colorant and a charge control agent; and an external additive added to the surface of the toner parent particles, wherein the external additive includes large particle diameter silica having a primary average particle diameter of about 30 to 100 nm; small particle diameter silica having a primary average particle diameter of about 5 to 20 nm; titanium dioxide or metal titanate; polymer beads having a primary average particle diameter of about 100 to 500 nm; and positively chargeable silica having a primary average particle diameter of about 20 to 100 nm, wherein the polymer beads are present in an amount of about 0.1 to 0.2 parts by weight based on 100 parts by weight of the toner parent particles.

* * * * *